US008690843B2

(12) United States Patent
Nakamura et al.

(10) Patent No.: US 8,690,843 B2
(45) Date of Patent: Apr. 8, 2014

(54) FACE MASK

(76) Inventors: Kenji Nakamura, Osaka (JP); Koji Nakamura, Osaka (JP)

( * ) Notice: Subject to any disclaimer, the term of this patent is extended or adjusted under 35 U.S.C. 154(b) by 99 days.

(21) Appl. No.: 12/919,089

(22) PCT Filed: Feb. 20, 2009

(86) PCT No.: PCT/JP2009/005298
§ 371 (c)(1),
(2), (4) Date: Nov. 10, 2010

(87) PCT Pub. No.: WO2009/110325
PCT Pub. Date: Sep. 11, 2009

(65) Prior Publication Data

US 2011/0045040 A1 Feb. 24, 2011

(30) Foreign Application Priority Data

Mar. 5, 2008 (JP) ..... 2008/054521

(51) Int. Cl.

| | |
|---|---|
| ***A61M 35/00*** | (2006.01) |
| ***A61Q 90/00*** | (2009.01) |
| ***A61Q 19/00*** | (2006.01) |
| *A61Q 19/10* | (2006.01) |

(52) U.S. Cl.
USPC ..... 604/303; 424/484; 514/844; 514/846; 514/847; 604/289

(58) Field of Classification Search
None
See application file for complete search history.

(56) References Cited

U.S. PATENT DOCUMENTS

2006/0130841 A1 * 6/2006 Spence et al. ..... 128/206.19

FOREIGN PATENT DOCUMENTS

| | | | |
|---|---|---|---|
| JP | 3072027 | U | 7/2000 |
| JP | 2004-2253 | A | 1/2004 |
| JP | 2004-97785 | A | 4/2004 |
| JP | 2006-42981 | A | 2/2006 |
| JP | 2006-340847 | A | 12/2006 |
| JP | 3138305 | U | 12/2007 |

OTHER PUBLICATIONS

Parker-Porter.Arch Facial Plast Surg/vol. 3, Jul.-Sep. 2001. pp. 191-197.*

* cited by examiner

*Primary Examiner* — David J Blanchard
*Assistant Examiner* — Lori K Mattison
(74) *Attorney, Agent, or Firm* — Knobbe, Martens, Olson & Bear LLP

(57) ABSTRACT

A face mask that has tab parts at opposing positions approximately on an upper side of the face shape, and a ridge-folded part and a valley-folded part are alternately folded in a lateral direction of the face and further folded perpendicularly to these folding lines, where the tab parts are folded in a manner projecting outward, so that the face mask having such fold structures can easily be spread out.

8 Claims, 3 Drawing Sheets

FACE MASK

This application is the U.S. National Phase under 35 U.S.C. §371 of International Application PCT/JP2009/052983, filed Feb. 20, 2009, which claims priority to Japanese Patent Application No. 2008-054521, filed Mar. 5, 2008. The International Application was not published under PCT Article 21(2) in English.

TECHNICAL FIELD

The present invention relates to a face mask of a so-called impregnated type having tab parts that has been impregnated with a liquid cosmetic for mask.

The present invention also relates to a face mask for beautifying the face having tab parts and offering excellent ease of spreading out, convenience and fitness.

More specifically, the present invention relates to an impregnated-type face mask that allows for easy unfolding and spreading-out of the base sheet material impregnated with a liquid cosmetic that can be easily restored to a flat state from a folded state where the sections of the sheet are contacting each other.

PRIOR ART

One beauty technique that has been used for many years is to apply an agent having the property to dry after application, such as a peel-off type mask material, onto the skin surface to add moisture and flexibility to the horny layer of the skin while removing dirt and impurities trapped on the skin surface.

Face masks have been known, where a non-woven fabric sheet formed in the shape of a face and impregnated with a cosmetic lotion is attached over the face of the user. However, these masks are packed in a folded state and therefore, despite their product claim that spreading out the sheet is easy, in reality the user who tries to extend the folded face mask into the face shape at the time of use finds that sections of the sheet stick together and are difficult to separate and thus the liquid cosmetic easily attaches to the hands and makes the hands wet, and that even though the sheet can be spread out relatively easily until halfway, spreading it out fully is difficult and eventually repeated actions are needed to achieve a completely spread sheet. These inconveniences have made the user dissatisfied.

As shown in FIG. 2(*a*), for example, the aforementioned face mask 1 is sized to cover roughly the entire face, and has cut lines 2 of reverse-U shapes made at the positions of the eyes as well as a slit 5 at the position of the nose. A hole 7 having the shape of the mouth is also formed at the position of the mouth. The aforementioned cut lines 2 of reverse-U shapes at the positions of eyes are folded by the user at the time of use so that there will be openings around the eyes. Multiple slits 6 extending inward are provided along the periphery of the face mask 1 to make the face mask conform easily to the face. Furthermore, at least two jutting tab parts 10 are formed along the periphery of the face mask 1, so that both tab parts 10 can be pinched with fingers to easily spread out the folded face mask 1. The upper part of the face mask 1 is folded toward the front as viewed on the drawing, along a folding line 41 denoted by a two-dot chain line that is provided horizontally slightly above the aforementioned tab parts 10, to obtain the condition in FIG. 2(*b*). Thereafter, the face mask 1 is folded toward the front as viewed on the drawing, in the direction of the arrow shown in FIG. 2(*b*), along a folding line 21 denoted by a two-dot chain line that roughly divides the width of the mask into three equal parts, to obtain the condition in FIG. 2(*c*). Thereafter, the mask is folded toward the back as viewed on the drawing, along a folding line 22 denoted by a two-dot chain line, to finally achieve a 3Z-fold structure constituted by three sections of the sheet stacked on top of each other. A face mask 1 that has been folded as explained above and where the tab parts 10 appear on the left and right sides of the folded mask, is known (Patent Literature 1).

Accordingly, another face mask was devised which has the following structure. As shown in FIG. 3(*a*), the face mask 1 is folded toward the front as viewed on the drawing, in the direction of the arrow shown at the upper part of the same figure, along a folding line 21 denoted by a two-dot chain line that roughly divides the width of the mask into three equal parts, after which the mask is folded toward the back as viewed on the drawing, in the direction of the arrow shown at the bottom of the same figure, along a folding line 22 denoted by a two-dot chain line, to achieve a 3Z-fold structure constituted by three sections of the sheet stacked on top of each other as illustrated by the side view in FIG. 3(*b*), and then the face mask is folded toward the front or back as viewed on the drawing, along a folding line 41 denoted by a two-dot chain line that is provided horizontally slightly below the aforementioned tab parts 10.

In addition, another fold structure is known, wherein the face mask 1 is divided into the left area and right area along a vertical center line, with a 3Z-fold structure created in the left area and reverse-3Z-fold structure in the right area, after which the mask is folded into two along a lateral folding line so that the aforementioned 3Z-fold and reverse-3Z-fold are positioned on the outside, respectively, and the left edge and right edge of the face mask 1 jut from the folding lines for use as tab parts (Patent Literature 2).

Furthermore, a fold structure (Patent Literature 3) similar to the aforementioned proposal has been proposed, wherein openers that open the fold structure are folded in a lateral direction into the base sheet at the position where the face mask 1 is roughly divided into two parts of top and bottom, with the aforementioned openers jutting from the outermost position of the folding line for use as tab parts.

However, the folding means, etc., described in Patent Literatures 1, 2 and 3 mentioned above all create a structure where tab parts are positioned on the left and right sides of the face mask 1 near the ear positions at the vertical center of the mask, and the parts are used to spread out the face mask 1 to the left and right of the face. When the left/right pinching parts are pinched with hands to spread out the face mask, the face mask is still vertically folded as in the condition shown in FIG. 2(*b*) and the user must perform a cumbersome operation of re-gripping the face mask 1 and spreading out roughly the upper half of the mask.

Also when the upper half of the face mask 1 is spread upward from the condition shown in FIG. 2(*b*), the reverse-U parts separated by cut lines 2 of reverse-U shapes stick to the bottom half of the face mask 1 due to the adhesive force of liquid cosmetic. As a result, when attaching the face mask 1 to the face the user must perform a cumbersome operation of re-gripping the mask so that the reverse-U parts do not come to the face side. Furthermore, if the reverse-U parts are not separated, the user must perform a cumbersome operation of manually pinching and opening the parts.

The inventors of the present invention found that the basis weight (weight per unit area) of the base sheet and viscosity of the liquid cosmetic material impregnated into the sheet were related to the ease of spreading out/unfolding, deformation and breaking of the folded face mask 1 as well as dripping of impregnated liquid cosmetic material, and proposed face masks designed to improve the foregoing (Patent Literatures 4, 5). In recent years, however, the trend is to use highly viscous cosmetic materials to enhance the beautifying effects of masks and prevent dripping of cosmetic material. Accordingly, the market is demanding face masks that can also meet this new condition. As explained above, the means, etc., described in the aforementioned patent literatures did not necessarily address this need fully.

Patent Literature 1: Japanese Utility Model Registration No. 3072027

Patent Literature 2: Japanese Patent Laid-open No. 2006-42981

Patent Literature 3: Japanese Patent Laid-open No. 2006-340847

Patent Literature 4: Japanese Patent Laid-open No. 2004-2253

Patent Literature 5: Japanese Patent Laid-open No. 2004-97785

SUMMARY OF THE INVENTION

Problems to be Solved by the Invention

In light of the prior art mentioned above, an object of the present invention is to provide a face mask that allows for easy spreading-out of the folded face mask without causing deformation or breaking, while also offering favorable usability, high beautifying effect and good fitness, even when highly viscous cosmetic material or a thin, easily stretchable base sheet is used.

Furthermore, another object of the present invention is to provide a face mask that can be easily impregnated during manufacturing and also when used, can be spread out with a single operation and attached directly over the face without re-gripping.

Means for Solving the Problems

After repeated examinations in earnest to solve the aforementioned problems, the inventors of the present invention completed (accomplished or achieved) the present invention. Specifically, the invention in Embodiment 1 is a face mask formed into a shape that can cover the face, with its base sheet impregnated with a liquid cosmetic material and folded in an extendable manner for use, wherein the aforementioned face mask is characterized in that tab parts are provided at opposing positions approximately on an upper side of the face shape, that a ridge-folded part and a valley-folded part are alternately folded in a lateral direction of the face and further folded across these folding lines, and in that the aforementioned tab parts jut out of the folded face mask, and wherein such face mask provides a fold structure having favorable spreadability.

The invention in Embodiment 2 is a fold structure of face mask according to Embodiment 1, wherein the face mask is characterized in that it is folded in the lateral direction of the face based on the 3Z-, 5Z- or 7Z-fold structure. The 3Z-fold represents a condition where the mask is folded in alternate directions into a shape of Z having three layered sections. The 5Z-fold and 7Z-fold represent conditions where the mask is folded in alternate directions into folding-fan-like [accordion-like] folding states having five and seven layered sections, respectively.

The invention in Embodiment 3 is a fold structure of face mask according to Embodiment 1 or 2, wherein the face mask is characterized in that it is folded in the lateral direction and further folded into two perpendicularly to this folding line, or into a 3C-fold or 3Z-fold. The 3C-fold indicates a condition where the upper part as viewed on the sheet of paper is folded toward the front, while the bottom part is also folded toward the front, to obtain three folded layers. The 3Z-fold is a Z-fold structure where the upper part as viewed on the sheet of paper is folded toward the front, while the bottom part is folded toward the back or toward the opposite side of the sheet of paper, to obtain three folded layers.

The invention in Embodiment 4 is a face mask according to any one of Embodiments 1 to 3, characterized in that the base sheet is a fiber sheet of 30 g/m2 to 80 g/m2 in weight per unit area.

The invention in Embodiment 5 is a face mask according to any one of Embodiments 1 to 4, characterized in that the viscosity of the liquid cosmetic material is 0.5 Pa·sec to 10 Pa·sec.

The invention in Embodiment 6 is a face mask according to any one of Embodiments 1 to 5, characterized in that the base sheet has cut lines of reverse-U shapes at positions of the eyes of the face and these parts are folded beforehand at the base of the reverse-U. Folding beforehand at the base of the reverse-U means the reverse-U part is folded beforehand along the base which represents the line that, when connected to the U-shaped opening, creates a closed loop.

The invention in Embodiment 7 is a face mask according to any one of Embodiments 1 to 6, characterized in that a left/right identifier is provided on the tab part.

The invention in Embodiment 8 is a face mask according to any one of Embodiments 1 to 7, characterized in that a line for folding is provided at the base of the tab part.

Effects of the Invention

According to the face mask proposed by the present invention, the tab parts provided at opposing positions approximately on an upper side of the face shape are pinched with hands and pulled slightly to the left and right, upon which the alternately folded layers start to open in a lateral direction of the face, or specifically the mask starts to spread out as a three-dimensional shape having a ridge-folded part and a valley-folded part, while at the same time the parts folded across the lateral folding line (a first folding line) (the folding line formed across the first folding line is called a second folding line) start to open, and eventually the aforementioned folds impregnated with a liquid cosmetic open downward by their weight while the aforementioned tab parts are positioned above. In other words, while any conventional face mask was based on a fold structure wherein the folded face mask impregnated with viscous cosmetic solution must be forcibly pulled with a shearing force by pinching the tab parts, the face mask proposed by the present invention has a fold structure where the folded surfaces stacked on top of each other are pulled and separated from their edges one by one. This is like separating postcards that are stuck together from a corner. Thereafter, the aforementioned tab parts are further pulled to the left and right, and the upper side of the face mask spreads into a condition where it can be attached over the face immediately with ease. The crossing angle formed by the first folding line and second folding line should be adjusted to a range of approx. 45 to 120 degrees, or preferably to a range of 80 to 100 degrees, or most preferably to the right angle, in order to keep the fold structure compact and make it easy to pinch the tab parts.

In addition, the base sheet is a fiber sheet of 30 g/m$^2$ to 80 g/m$^2$ in basis weight (weight per unit area), which means that once the folded sheet is spread it no longer folds back easily but adheres properly to the face, and such sheet does not create a stuffy feeling, either. Also, despite the viscosity of liquid cosmetic materials being high, or at 0.5 Pa·sec to 10 Pa·sec, the folded layers do not stick too tightly, but they can be spread out easily. There is no discomfort felt on the face and the sheet also offers great fitness.

Moreover, the cut lines of reverse-U shapes provided at positions of the eyes of the face are folded beforehand at the reverse-U bases and the mask is folded with a ridge-folded part and a valley-folded part alternately folded in a lateral direction. When the face mask is spread out, therefore, the aforementioned parts at both eyes are folded in the same direction and holes open at the positions of eyes, so that it is easy to determine the position of the mask at the time of use and also the user who wants beautifying effects around the eyes can fold back the eye parts of the face mask and apply the mask with double layers covering under the eyes.

Also under the present invention, the tab part has a left/right identifier so that whether the aforementioned reverse-U folds at positions of the eyes of the face are oriented toward the face or opposite side can be easily identified and the user can easily determine which of the left and right hands the user should use to pinch each tab part of the face mask.

Furthermore, a line for folding is provided at the base of each tab part under the present invention, which means that when the face mask is put on the face, the aforementioned bases of the tab parts can be folded so that they cover the corners of the eyes and therefore the easy-to-wrinkle areas around the corners of the eyes can be more thoroughly treated by the double face mask layers, and the user can surely be satisfied.

As mentioned before, the face mask proposed by the present invention presents various fantastic effects including excellent ease of spreading out, convenience, fitness, economy, and greater user satisfaction, among others.

DESCRIPTION OF THE SYMBOLS

Figure 1A:
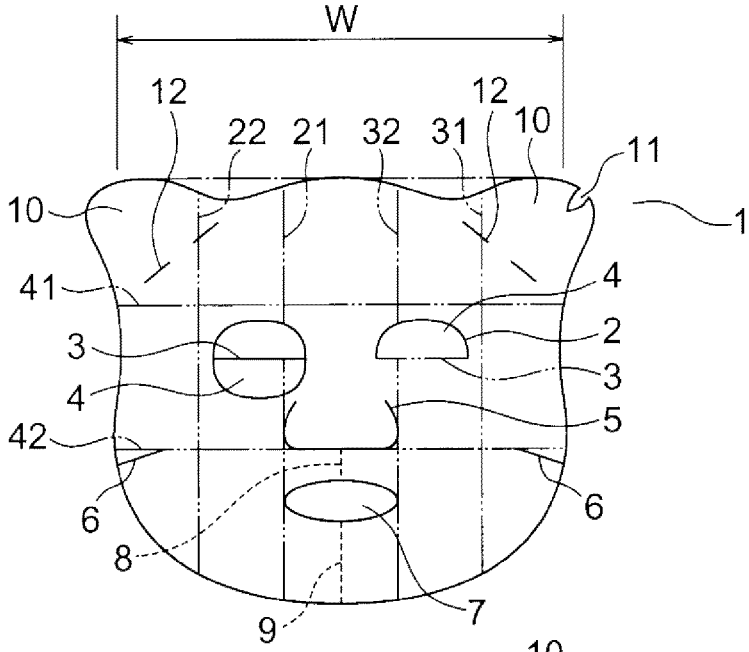
FIGS. 1(*a*) to 1(*e*) illustrate a face mask according to the present invention, where FIG. 1(*a*) is a front view of the spread-out structure, FIGS. 1(*b*), 1(*c*) and 1(*d*) each show a front view and a cross sectional view of the laterally folded structure, while FIG. 1(*e*) shows a front view of the vertically folded structure.

1 Face mask
2 Cut line
3 Base
4 Eyelid
5, 6 Slit
7 Hole for mouth
8, 9 Cut line
10 Tab part
11 Cutout identifier
12 Folding line
13 Fold
21 Folding line
22 Folding line
31 Folding line
32 Folding line
41 Folding line
42 Folding line

BEST MODE FOR CARRYING OUT THE INVENTION

The face mask proposed by the present invention offers excellent convenience because the tab parts need not be re-gripped in order to spread out the upper half of the face mask, which has been the case with conventional face masks. When the periphery of the forehead area at the upper center of the face mask is aligned approximately with or lower than the top of the tab parts, the mask does not sag when the tab parts are pulled to the left and right, which makes it easy to spread out and use the mask. However, the present invention is not at all limited to this mode and a situation where the top of each tab part is positioned slightly below the periphery of the forehead area at the upper side center of the face mask is also considered an embodiment of the present invention as long as the periphery of the forehead area at the upper center of the face mask does not sag and obstructs the user from putting on the face mask that has been spread out by gripping the tab parts.

In addition, any of the preferred fold structures of 3Z-, 5Z- and 7Z-fold can be selected as the lateral fold structure so that size variations can be offered and users of small face or large face can select different face mask sizes, which provides greater convenience to the users who are looking for versatility. Also by folding the mask more than twice in the vertical direction, the width of the folded face mask decreases and the width of the packaging bag can be decreased, which reduces the cost of the packaging bag and makes it more convenient for the users to carry the mask when traveling, etc. Such fold structure makes it easy to impregnate the base sheet of the face mask during manufacturing and also leads to excellent ease of unfolding the sheet when used, which is a further advantage.

The base sheet used by the present invention is not specifically limited so long as it can be folded and impregnated with a liquid cosmetic material. However, a fiber sheet such as non-woven sheet, woven sheet or knitted sheet can be used favorably. To give a tight feeling on the face, a stretchable fiber sheet can also be used favorably.

The best mode for carrying out the present invention is explained below in detail by referring to the drawings.

Figure 1B:
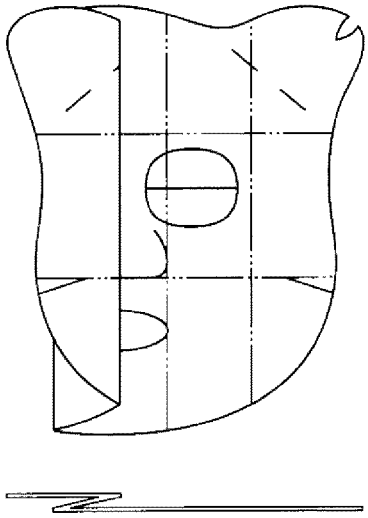
Figure 1D:
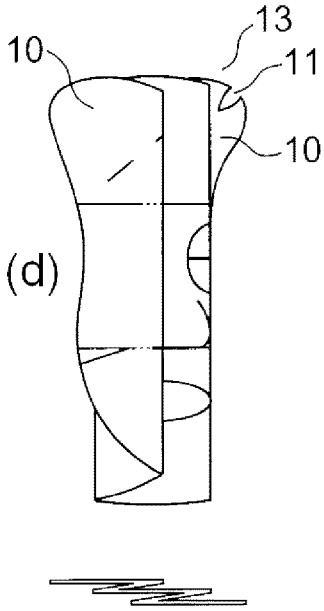
Figure 1C:
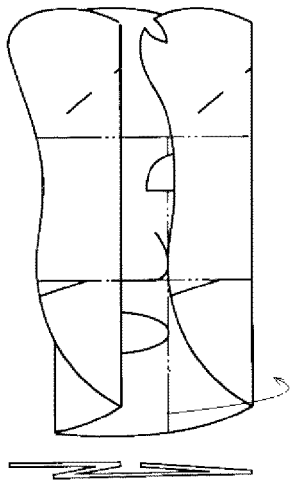
Figure 1E:
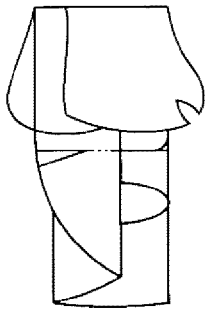
Figure 2A:
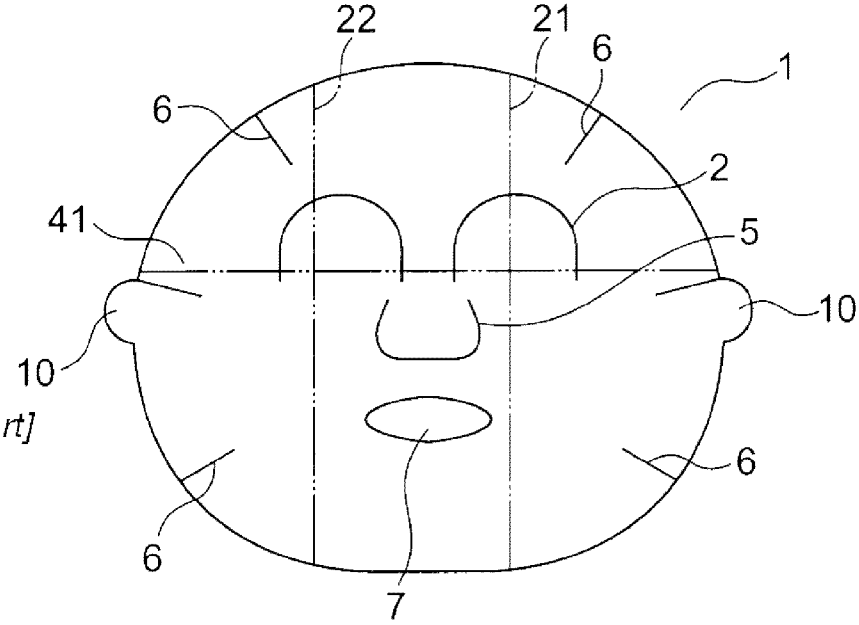
Fig.2(a) [Background Art]
FIGS. 2(*a*) to 2(*c*) illustrate a conventional face mask, where FIG. 2(*a*) is a front view of the spread-out structure and FIGS. 2(*b*) and 2(*c*) each show a front view and a cross sectional view of the folded structure.
Figure 2B:
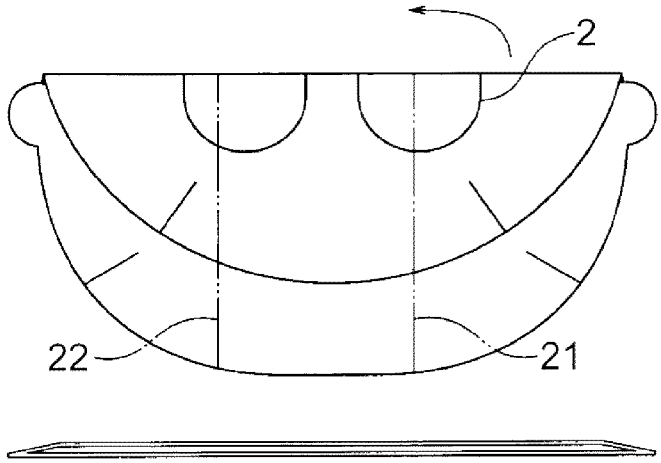
Fig.2(b) [Background Art]
Figure 2C:
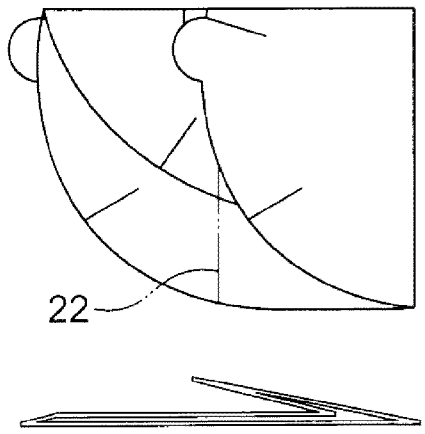
Fig.2(c) [Background Art]
Figure 3:
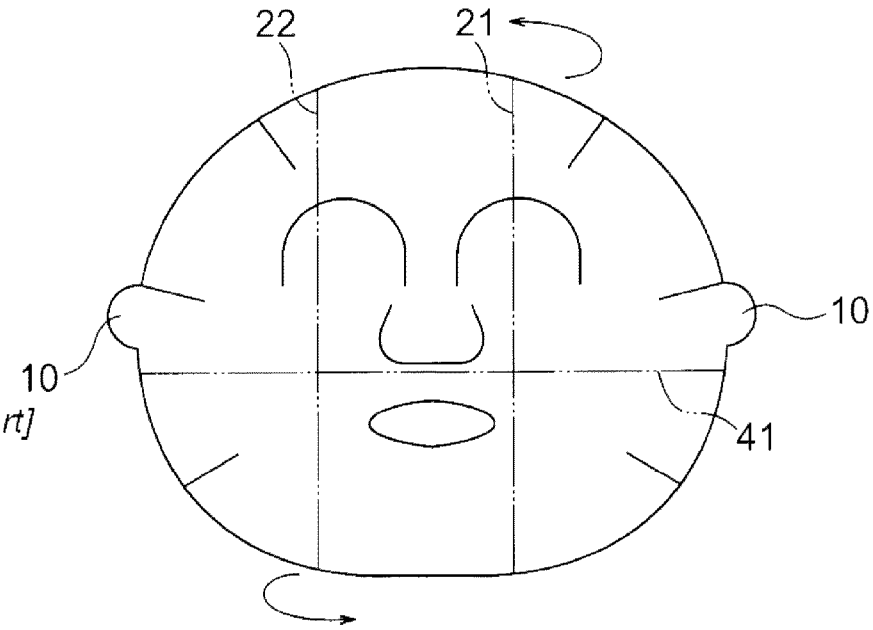
Fig.3 (a) [Background Art]
FIGS. 3(*a*) and 3(*b*) illustrate a conventional face mask, where FIG. 3(*a*) is a front view of the spread-out structure and FIG. 3(*b*) shows a front view and a cross sectional view of the folded structure.
Figure 3:
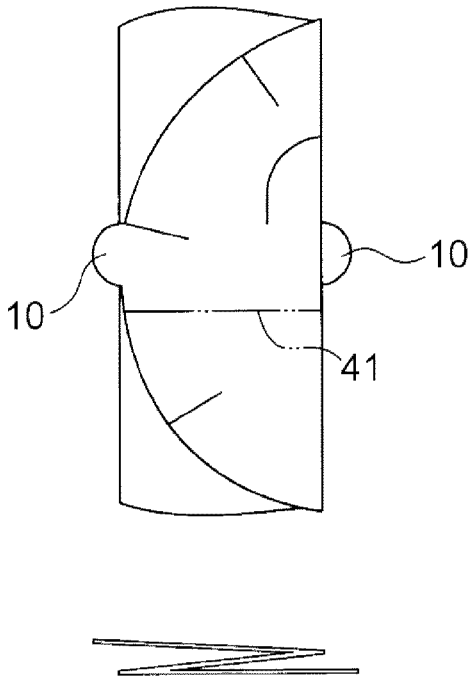
Fig.3 (b) [Background Art]

FIG. 1(*a*) is a front view of a face mask 1 formed by non-woven fabric. In this figure, reference numeral 2 indicates a cut line of a reverse-U shape provided at the position of each eye of the face, where an eyelid part 4 is folded downward at a base 3 as shown to the left. The eyelid part 4 shown on the right side is also folded downward just like on the left side. The right eye is given for explanation. After the face mask 1 is put on the face, each eyelid part 4 that has been folded downward as shown on the right side is folded back over the eye as shown on the right side in the same figure. The eye parts can also be formed as laterally elongated oval holes, etc. (not illustrated). A reverse-U slit 5 is also formed at the position of the nose, and multiple slits 6 extending inward are provided along the periphery of the face mask 1 so that the face mask can easily conform to the face. Formed at the mouth is an oval hole 7 for mouth. Reference numeral 8 indicates a cut line formed between the aforementioned slit 5 for nose and hole 7 for mouth, while reference numeral 9 is another cut line provided from the aforementioned hole 7 for mouth to the periphery of the face mask 1 at the chin, where the perforated slits allow for easy separation. After the face mask 1 is attached over the face, these slits 8, 9 are separated and looseness or tautness of the face mask 1 is adjusted around the mouth, wings of the nose, cheeks, etc. Reference numeral 10 is a tab part, where two of this part are provided at opposing positions in the upper side of the face shape. The top part of the periphery of this tab part 10 is formed at a position in the horizontal direction equal to or higher than the top part of the periphery of the forehead area at the center of the face mask 1. This tab part 10 is formed on the left and right sides in a manner jutting from the width W of the face mask 1, and has just enough size to be pinched with human fingers. Desirably this tab part 10 should be formed in a shape similar to a dog's ear when viewed from the front. Reference numeral 11 is a cutout that functions as an identifier on the tab part 10 on the right side. This cutout identifier 11 is subordinately determined by the folding direction of the eyelid part 4, and when the aforementioned eyelid part 4 is folded downward toward the front as viewed on the drawing and as illustrated in FIG. 1(*a*), this cutout identifier is provided on the right side as shown in FIG. 1(*a*). In other words, on the face mask 1 shown in FIG. 1(*a*), the side attached to the face is not the front side as viewed on the drawing, but the back side, and accordingly the right tab part is pinched with the left hand. Once the face mask is put on, the areas contacting the eyes are doubly layered because the eyelid parts are folded, which allows for intensive treatment around the eyes. In the illustrated embodiment, the eyelid parts are already folded when the face mask is put on. However, the present invention is not at all limited to this design and the eyelid parts can also be folded inward.

Additionally, it is also possible to not provide identifiers 11, as long as the left and right can be identified by printing left and right markers, attaching labels, or by other means. Reference numeral 12 indicates a line for folding provided at the base of the aforementioned tab part 10 (this line can be a non-continuous slit, for example). After the face mask 1 is attached over the face, each tab part 10 is folded at the position of the folding line 12 and the tab part 10 is overlaid at the position corresponding to the corner of the eye.

Reference numerals 21, 22, 31 and 32 are folding lines that roughly divide the width W of the face mask 1 into five, while reference numerals 41 and 42 are folding lines provided roughly perpendicularly to the folding lines 21, 22, 31, 32 and in a manner roughly dividing the face mask 1 into three.

FIG. 1(*b*) shows a condition where the face mask 1 is folded inward toward the center along the vertical folding line 21 and then folded outward toward the outside of the face along the vertical folding line 22, thereby creating a Z-fold in the side view as shown at the bottom of the same figure where the face mask 1 is 3Z-folded into three layers. Furthermore in FIG. 1(*c*) the face mask 1 is folded inward toward the center along the folding line 31 and then folded outward toward the outside of the face or to the back as viewed on the drawing along the folding line 32. In a folded body 13 shown in FIG. 1(*d*), the face mask 1 is 5Z-folded into five layers stacked on top of each other, where the tab parts 11 jut outward to the left and right from the folding lines 21 and 32, respectively, when the face mask is folded. As shown in the cross-section view showing the folded condition, reducing the area of the folded and thus overlapping parts makes it easy to spread out the folds even when a highly viscous liquid cosmetic material is impregnated. FIG. 1(*e*) shows a condition where the folded body 13 is folded toward the front as viewed on the drawing along the folding line 41, and then folded toward the front as viewed on the drawing along the folding line 42 to create a 3C fold, or folded toward the back as viewed on the drawing along the folding line 42 to create a 3Z-fold. With this folding of the face mask 1, the entire folding process of the face mask 1 is complete.

In the foregoing, the width W of the face mask 1 was roughly divided into five. However, it can also be divided roughly into three or seven. Also, a folding line perpendicular to the vertical folding lines can be provided approximately at the center of the folded body 13, to fold the mask into two. Which one of the aforementioned folding types should be selected can be determined based on the size (large, medium or small) of the face mask 1 and optimal economy of the packaging bag.

When the face mask 1 folded in the manner mentioned above is used, first the tab part having the cutout identifier 11 is pinched with the left hand, and the opposing tab part is pinched with the right hand, and when both parts are pulled slightly to the left and right, the mask spreads out easily. Since the tab parts 10 are pulled to the left and right at opposing positions approximately on an upper side of the face shape to spread out the face mask 1, the forehead area spreads out unfailingly and can be immediately attached over the forehead of the face. Even when the folded area is present at the bottom of the face mask 1 where layers are stacked on top of each other, such area can be easily unfolded while the face mask 1 is put on the face so that the face mask 1 can be attached over the bottom of the face with ease.

In the aforementioned folding process, the base sheet supplied continuously from the base material roll is stamped and formed, after which the eyelid parts around the eyes are folded toward the front side, and the face shape is folded laterally and then vertically in the order mentioned above, after which each folded mask is packed in a bag and the bag is filled with a liquid cosmetic and then sealed. The individually packed face mask 1 is accumulated into a box that contains several masks, and several of this box are put together in a larger box and shipped.

What is claimed is:

1. A folded face mask extendable into a shape that can cover a face, formed of a single planar base sheet impregnated with a liquid cosmetic material, wherein:

the folded face mask has 15 layers in a thickness direction consisting of upper 5 Z-fold layers corresponding to a top horizontal section of the planar base sheet of the face shape, middle 5 Z-fold layers corresponding to a middle horizontal section of the planar base sheet of the face shape, and lower 5 Z-fold layers corresponding to a lower horizontal section of the planar base sheet of the face shape, a top layer and a bottom layer of the upper 5 Z-fold layers have tab parts outwardly jutting from the left and right sides of the folded face mask for gripping, respectively, said tab parts corresponding to opposing horizontal ends of the top horizontal section of the planar base sheet of the face shape, the width between the opposing horizontal ends of the tab parts of the top horizontal section of the planar base sheet is greater than the width of the middle and lower horizontal sections of the planar base sheet, and the center of the top periphery of the top horizontal section is aligned with or lower than the top periphery of the tab parts, and the folded face mask is capable of being fully deployed with a single operation by gripping and pulling the tab parts jutting outwardly from the left and right sides of the folded face mask in the opposing jutting directions of the tab parts, and is also capable of being applied directly over the face without re-gripping.

2. The face mask according to claim 1, wherein the widths of first, third, and fifth vertical sections are greater than those of second and fourth vertical sections so as to reduce an area of the folded and thus overlapping parts.

3. The face mask according to claim 1, wherein the base sheet is a fiber sheet of 30 $g/m^2$ to 80 $g/m^2$ in weight per unit area.

4. The face mask according to claim 1, wherein the base sheet has cut lines of reverse-U shapes at positions of the eyes of the face and these reverse-U shapes are folded and attached to the base sheet.

5. The face mask according to claim 1, wherein the tab parts have a left/right identifier.

6. The face mask according to claim 1, wherein the tab parts have a line for folding at their bases.

7. The face mask according to claim 2, wherein the base sheet is impregnated with a viscous liquid cosmetic material.

8. The face mask according to claim 1, wherein the liquid cosmetic material has a viscosity of 0.5 Pa·sec to 10 Pa·sec.

* * * * *

UNITED STATES PATENT AND TRADEMARK OFFICE

CERTIFICATE OF CORRECTION

PATENT NO. : 8,690,843 B2
APPLICATION NO. : 12/919089
DATED : April 8, 2014
INVENTOR(S) : Nakamura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 173 days.

Signed and Sealed this
Twenty-ninth Day of September, 2015

Michelle K. Lee

Michelle K. Lee
*Director of the United States Patent and Trademark Office*